United States Patent [19]

Syvakari

[11] 4,195,505

[45] Apr. 1, 1980

[54] PRESS FOR HYDROSTATIC EXTRUSION OF TUBES

[75] Inventor: Pertti Syvakari, Helsingborg, Sweden

[73] Assignee: ASEA AB, Vasteras, Sweden

[21] Appl. No.: 961,850

[22] Filed: Nov. 17, 1978

[30] Foreign Application Priority Data

Nov. 22, 1977 [SE] Sweden ..... 7713163

[51] Int. Cl.[2] ..... B21D 22/10

[52] U.S. Cl. ..... 72/60; 72/272

[58] Field of Search ..... 72/60, 272, 273, 270

[56] References Cited

U.S. PATENT DOCUMENTS

| | | | |
|---|---|---|---|
| 3,751,958 | 8/1973 | Nilsson | 72/60 |
| 3,914,981 | 10/1975 | Nilsson | 72/60 |
| 3,934,442 | 1/1976 | Larker | 72/60 |
| 4,016,737 | 4/1977 | Gustafsson | 72/60 |
| 4,081,984 | 4/1978 | Gustafsson | 72/272 |

*Primary Examiner*—Leon Gilden

*Attorney, Agent, or Firm*—Watson, Cole, Grindle & Watson

[57] ABSTRACT

In a press for the hydrostatic extrusion of tubes, including a mandrel unit permanently inserted in the pressure chamber of the press and being movable between two axial positions, the unit comprising a mandrel and a tubular sleeve which during the extrusion transmits forces acting on the mandrel to a force-absorbing unit in the press, the sleeve being so constructed as to form an annular gap between the sleeve and the pressure chamber wall, and a stop ring in the gap forming an interference fit with the pressure chamber wall, the sleeve having stop faces thereon designed to cooperate with end faces of the stop ring so as to determine the limit positions of the axially movable mandrel unit.

3 Claims, 1 Drawing Figure

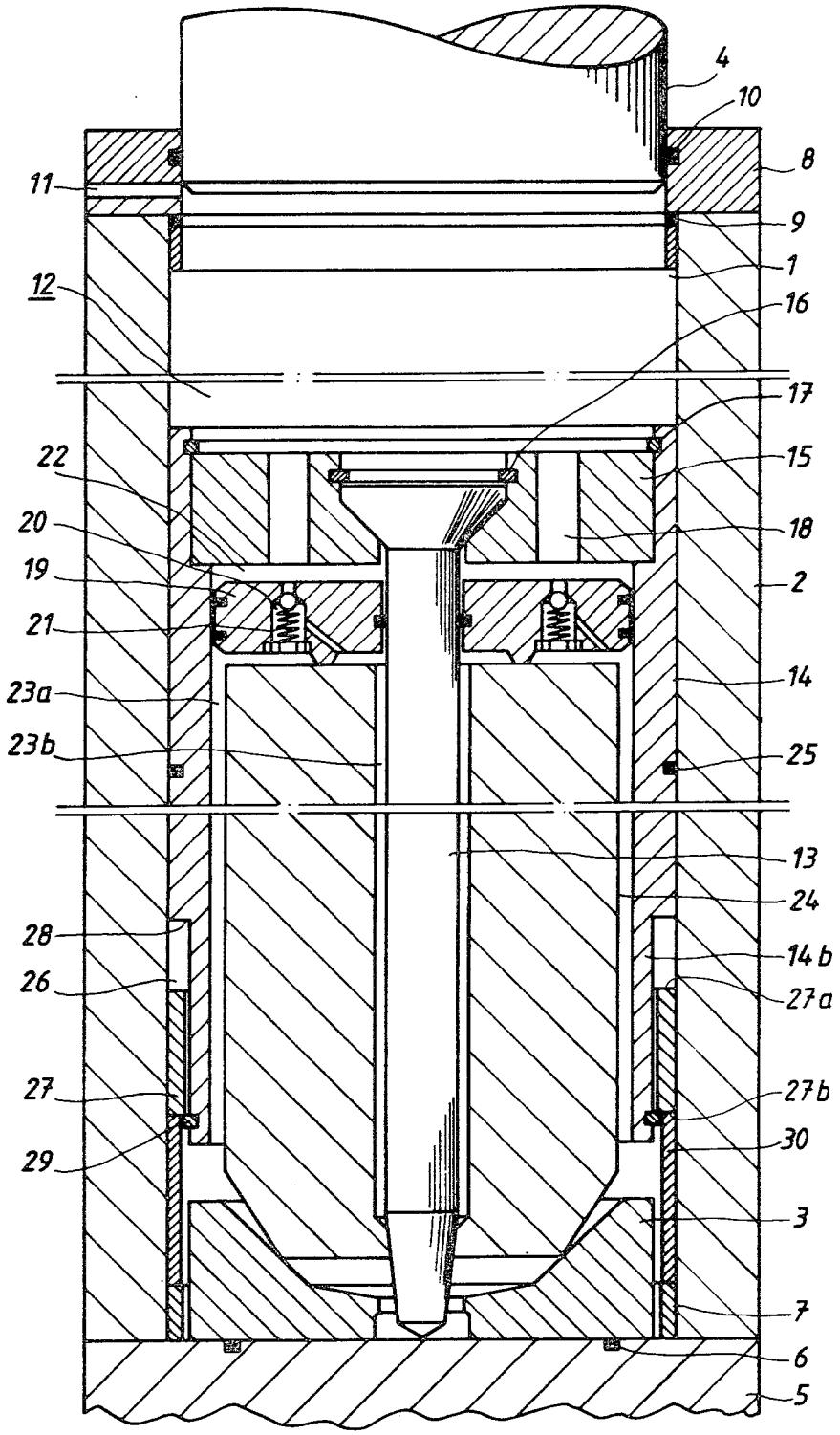
4
10
8
11
9
1
12
16
17
22
15
20
18
19
2
21
14
23a
23b
25
13
24
28
14b
26
27a
27
27b
29
30
3
7
6
5

PRESS FOR HYDROSTATIC EXTRUSION OF TUBES

BACKGROUND OF THE INVENTION

The present invention relates to a press for the production of tubes by means of hydrostatic extrusion. The extrusion can be carried out both at room temperature and at an elevated temperature of the starting billet. A press of this type and its mode of operation are described in detail in U.S. Pat. No. 3,751,958, commonly owned herewith.

In extrusion presses of the type relating to the invention, the press chamber contains a permanently inserted unit comprising a mandrel and a tubular sleeve which, during the pressing operation, transmits the forces acting on the mandrel to a force-absorbing unit in the press, usually to the die. When withdrawing extrusion residues and inserting a new extrusion billet in an open pressure chamber, the unit containing the mandrel and the sleeve is movable to a limited extent between two axial limit positions which are determined by a stop member at the ends of the sleeve.

Also, in extrusion presses, stop rings have been used of the type forming an interference fit relative to the press cylinder at the inner end of the sleeve for limiting the axial movement. Despite a maximum interference fit, it has been found that the stop rings travel axially away from the sleeve, thus changing the limit position. The ring moves somewhat during each press cycle, but after a member of cycles the inner stop position may have been displaced so far inwardly toward the pressure-generating punch that the functioning of the press may become jeopardized. By providing a stop ring according to the invention, the ring is limited in its travel in a direction toward the pressure-generating punch.

SUMMARY OF THE INVENTION

The present invention relates to an improved press for the hydrostatic extrusion of tubes wherein limited axial movement of the mandrel unit inserted into the extrusion chamber is provided. According to the invention, the sleeve in the movable unit is provided with such an external diameter on part of its length that an annular gap is formed between the sleeve and the pressure chamber wall. A stop ring is disposed in the pressure chamber and lies in this gap at an interference fit with the wall of the chamber. The sleeve is provided with stop faces on either side of the stop ring which, upon an axial displacement of the sleeve and upon contact with the end surfaces of the ring, limit the movement of the sleeve in one or the other direction, and thus determine the axial limit positions of the mandrel unit. The stop faces may be in the form of a shoulder between two sleeve diameters and a detachable stop ring located in a groove on the sleeve.

BRIEF DESCRIPTION OF THE INVENTION

The invention is described in more detail with reference to the accompanying drawing FIGURE.

DETAILED DESCRIPTION OF THE INVENTION

In the single drawing FIGURE, 1 designates a press chamber which is defined by a high-pressure cylinder 2, a die 3 and a pressure-generating punch 4. The latter is driven in any normal manner by an operating cylinder in a press stand (not shown). A die support 5 and sealing rings 6 and 7 are located at the die end. The rings provide seals between the die and the die support, and against the inner surface of the cylinder 2 and against the die support, respectively. A seal holder 8, at the punch end of the pressure chamber, serves as a support for a seal 9 which seals between the punch 4 and the wall of the cylinder 2. Further, another seal 10 provides a seal between the seal holder 8 and the punch 4. Seal holder 8 has a channel 11 through which the press chamber 1 may be supplied with pressure medium when the punch 4 is in the position shown in the FIGURE. As the punch 4 passes the seal 9, the pressure chamber is closed and the pressure can be raised to the level required for extrusion.

The pressure chamber comprises a mandrel unit 12 which is axially movable to a limited extent and comprises a mandrel 13, a tubular sleeve 14 and a plate 15 which transmits tensile forces, acting on the mandrel 13 during the extrusion, to the tubular sleeve. This tubular sleeve 14 rests against the die 3 during the extrusion, die 3 thus taking up the forces and forwarding them to the die support 5. The mandrel 13 is fixed to plate 15 by a lock ring 16. The plate 15 in turn is fixed to the sleeve 14 by a lock ring 17. Through channels 18 are provided in the plate 15 permitting pressure to press freely therethrough from the space on one side of the plate to the space on the other side of the plate.

The mandrel unit 12 comprises a billet-holding piston 19, arranged in a known manner, with valves 20 which, at a pressure differential determined by one of the spring 21 of the valve, permit pressure medium to flow from space 22 to spaces **23*a* and 23*b* on the other side of the piston 19 and fill these spaces so that a billet 24 disposed in the press is completely surrounded by pressure medium. The sleeve 14 may include a sealing ring 25** sealing between the sleeve and the surrounding wall.

The outer portion **14*b* of the tubular sleeve 14 has a smaller external diameter than the remaining portion of the sleeve, thus forming an annular space 26 between sleeve 14 and cylinder 2. A stop ring 27 is located in this space and is axially fixed to the cylinder 2 by having the external diameter of ring 27 slightly greater than the internal diameter of cylinder 2 to thereby obtain an interference fit. An annular surface 28 is defined by the shoulder formed between the smaller external diameter of portion 14*b* and the remaining larger diameter of sleeve 14. The stop ring 27 has a smaller axial extent than the distance between the annular surface 28 and a lock ring 29 mounted on sleeve 14 near the distal end of portion 14*b*. The annular surface 28 and the inner side surface of the lock ring 29 form stop faces which, upon contact respectively with end surfaces 27*a* and 27*b* of the stop ring 27, limit the axial movement of the mandrel unit. A spacing ring 30 may be provided between the sealing ring 7 and the stop ring 27 for preventing stop ring 27 from moving outwardly toward the opening of the cylinder at the die end. As can be seen, end surface 27*b* is determined by the relative difference in wall thickness between rings 27 and 30**.

During the extrusion, the tubular sleeve 14 rests against the die 3, and because the length of space 26 is slightly greater than the distance between the end of portion **14*b* and the die 3, the surface 28 limits the travel of the ring 27 toward the piston end of the cylinder 2. The invention therefore makes its possible in a simple manner to prevent a shrunk-on stop ring from moving axially an impermissible long distance when the cylinder 2 at a high inner overpressure has expanded to such an extent that the retaining force between it and the stop ring has decreased or fully disappeared. Because the stop ring can be efficiently prevented from moving, a less interference fit is permissible since the ring can be allowed to lie completely freely in the cylinder 2** when the pressure during the extrusion is high. Such arrangement, and the possibility of positioning the ring near the cylinder end during assembly, facilitates a relatively easy insertion of the stop ring.

Obviously, many other modifications and variations of the present invention are made possible in the light of the above teachings. It is therefore to be understood that within the scope of the appended claims, the invention may be practiced otherwise than as specifically described.

I claim:

1. A press for the hydrostatic extrusion of tubes, including a press chamber defined by a pressure cylinder, a die at one end of said cylinder and a pressure-generating punch at an opposite end of said cylinder, a mandrel unit permanently disposed within said chamber and being movable between two axial positions, said unit comprising a mandrel and a tubular sleeve which, during an extrusion operation, is capable of transmitting forces acting on said mandrel to a force-absorbing unit in the press, the improvement wherein a portion of said sleeve has means thereon defining an annular gap between said sleeve and the wall of said cylinder, a stop ring located in said gap, said stop ring having an outer diameter slightly greater than the inner diameter of said cylinder wall so as to form an interference fit within said press chamber, said stop ring having opposed end faces spaced a first predetermined distance apart, and said sleeve having a pair of stop faces thereon spaced a second predetermined distance apart greater than said first distance, said end faces respectively engaging said stop faces during axial movement of said mandrel unit for determining the limit positions of said mandrel unit.

2. The press according to claim 1, wherein said sleeve has a first outer diameter and said sleeve portion has a second outer diameter less than said first diameter to thereby form said gap defining means having a shoulder at the transition between said diameter, said sleeve portion facing said one end of said cylinder, one of said stop faces being defined by said shoulder, and a lock ring located on said sleeve portion defining the other of said stop surfaces.

3. The press according to claim 1, wherein a sealing ring is provided within said chamber at said one end, and a spacing ring is located between said sealing ring and said stop ring.

* * * * *